US009925404B1

(12) United States Patent
West

(10) Patent No.: US 9,925,404 B1
(45) Date of Patent: Mar. 27, 2018

(54) RETRACTABLE EXERCISE BAND

(71) Applicant: Cody Joshua West, Murfreesboro, TN (US)

(72) Inventor: Cody Joshua West, Murfreesboro, TN (US)

( * ) Notice: Subject to any disclaimer, the term of this patent is extended or adjusted under 35 U.S.C. 154(b) by 0 days.

(21) Appl. No.: 15/412,720

(22) Filed: Jan. 23, 2017

(51) Int. Cl.

| | |
|---|---|
| ***A63B 21/02*** | (2006.01) |
| ***A63B 21/04*** | (2006.01) |
| ***A63B 21/055*** | (2006.01) |
| ***A63B 21/00*** | (2006.01) |
| ***A63B 23/12*** | (2006.01) |

(52) U.S. Cl.
CPC ..... *A63B 21/0442* (2013.01); *A63B 21/0552* (2013.01); *A63B 21/4011* (2015.10); *A63B 21/4035* (2015.10); *A63B 21/4043* (2015.10); *A63B 23/1281* (2013.01); *A63B 2208/0204* (2013.01); *A63B 2208/0233* (2013.01); *A63B 2209/10* (2013.01)

(58) Field of Classification Search
CPC ..... A63B 21/0442; A63B 23/1281; A63B 21/4035; A63B 21/4011; A63B 21/0552; A63B 21/4043; A63B 2208/0233; A63B 2208/0204; A63B 2209/10
USPC ..... 482/121–130
See application file for complete search history.

(56) References Cited

U.S. PATENT DOCUMENTS 3,268,225 A * 8/1966 Kolbel ..... A63B 21/00043 482/126
3,427,021 A * 2/1969 Donato ..... A63B 69/20 473/441
3,707,285 A * 12/1972 Martin ..... A63B 1/00 472/16
3,958,803 A * 5/1976 Geisselbrecht ..... A63B 21/026 267/149
D243,103 S * 1/1977 Hale ..... D21/692
4,290,600 A * 9/1981 Kolbel ..... A63B 21/05 482/126
4,333,645 A * 6/1982 Wu ..... A63B 21/00043 482/112
4,376,533 A * 3/1983 Kolbel ..... A63B 21/00043 482/125
4,900,019 A * 2/1990 Shamir ..... A63B 21/023 482/123
5,031,906 A * 7/1991 Jang ..... A63B 21/0004 482/125
5,071,119 A * 12/1991 Johnson ..... A63B 21/0087 482/112

(Continued)

*Primary Examiner* — Stephen R Crow
*Assistant Examiner* — Garrett Atkinson
(74) *Attorney, Agent, or Firm* — Shane V. Cortesi

(57) ABSTRACT

A retractable exercise band system is described. The retractable exercise band system may include at least one strap configured to be worn around a user's limb, a tube connected to the at least one strap and comprising a hollow interior, and an elastic band. The elastic band extends through the tube interior and may include a band top end connected to a handle configured to be grasped by a user's hand, and a band bottom end located below the tube bottom end. The retractable exercise band system is configured to remove from a collapsed position in which the handle is located a first distance from the tube top end to an extended position in which the handle is located a greater distance from the tube top end.

17 Claims, 6 Drawing Sheets

(56) References Cited

U.S. PATENT DOCUMENTS 5,222,927 A * 6/1993 Chang ..... A63B 21/0552 482/126
5,279,530 A * 1/1994 Hess ..... A63B 21/0552 482/121
5,295,935 A * 3/1994 Wang ..... A63B 21/0552 482/123
5,480,367 A * 1/1996 Bergman ..... A63B 21/0552 482/122
5,489,251 A 2/1996 Robles, Jr.
5,499,958 A * 3/1996 Hess ..... A63B 21/0552 482/123
5,700,232 A * 12/1997 Clausen ..... A63B 21/0552 482/125
6,042,523 A * 3/2000 Graham ..... A63B 21/0552 482/121
6,071,217 A * 6/2000 Barnett ..... A63B 21/0552 482/121
6,110,082 A * 8/2000 Tsai ..... A63B 21/0004 482/121
6,206,811 B1 * 3/2001 Lat ..... A63B 21/0004 482/121
6,488,614 B1 * 12/2002 Chang ..... A63B 21/0608 482/110
6,966,871 B2 * 11/2005 Parmater ..... A63B 21/023 482/129
7,288,052 B1 * 10/2007 Guillaume ..... A63B 21/055 482/121
D562,913 S * 2/2008 Grossman ..... D21/413
7,361,126 B2 * 4/2008 Bruce ..... A63B 21/0087 482/121
7,758,436 B2 7/2010 Reynolds
7,780,585 B1 * 8/2010 Rivas ..... A63B 21/0552 482/140
8,118,716 B2 * 2/2012 Grossman ..... A63B 25/08 482/77
8,430,800 B2 * 4/2013 Nolan ..... A63B 21/023 482/121
8,500,611 B2 * 8/2013 Hoffman ..... A63B 21/055 482/123
8,602,952 B1 * 12/2013 Cruz ..... A63B 21/04 482/121
9,162,100 B2 10/2015 Rasnake
2004/0053756 A1 3/2004 Tremayne
2009/0253561 A1 10/2009 Centrella
2010/0292055 A1 11/2010 Andrich
2011/0294631 A1 * 12/2011 Wu ..... A63B 21/0552 482/129
2012/0053026 A1 3/2012 Kopp
2012/0202659 A1 8/2012 Wroclawsky
2013/0316882 A1 11/2013 Param

* cited by examiner

RETRACTABLE EXERCISE BAND

BACKGROUND

Technical Field

The present invention relates to exercise devices more particularly to bands that use tension and can be used for curling.

Background of the Invention

Traditionally, dumbbell curls are used for strengthening one's biceps. However, dumbbells are not easily used when traveling for example.

U.S. Pat. No. 5,489,251 describes a leg curl device that includes a foot harness and a plate that is securable around a user's thigh via straps. The device further includes a tubular housing having an elongated passageway, a spring plate slideably disposed within the passageway, a spring and a flexible, fixed length tension member attached to the spring. The user is able to selectively position the spring plate within the housing to adjust tension of the device. The aforementioned patent does not teach the tension member has an adjustable length or a tension member that fully retracts into the tube, which could be dangerous and make the tension member prone to tangling.

Thus, alternative exercise devices are needed.

BRIEF SUMMARY

The present disclosure relates to a retractable exercise band system as described herein. In some embodiments, the present disclosure provides a retractable exercise band system comprising: a) at least one strap configured to be worn around a user's limb; b) a tube connected to the at least one strap and comprising a hollow interior, a tube top end comprising a top opening, a tube bottom end comprising a bottom opening, a tube length extending from the tube top end to the tube bottom end, and a tube width generally perpendicular to the tube length; and c) an elastic band extending through the tube hollow interior and comprising a band top end connected to a handle configured to be grasped by a user's hand, a band bottom end, a band length extending from the band top end to the band bottom end and generally parallel to the tube length. Optionally, the handle comprises a handle top. Optionally, the band has an extended position in which the band has a first length and in which the handle top is located a first height above the tube top end, the band has a collapsed position in which the band has a second length and in which the handle top is located a second height above the tube top end, the first length greater than the second length, the first height greater than the second height, and, in the collapsed position and the extended position, the band bottom end is located below the tube bottom end.

Optionally, the band bottom end is connected to a bottom flange and further wherein in the collapsed position and the extended position, the bottom flange is located below the tube bottom end. Optionally, the tube interior has a tube interior width generally perpendicular to the tube length and the bottom flange has a bottom flange width generally parallel to the tube interior width, and further wherein the bottom flange width is greater than the tube interior width. Optionally, the system further comprises a top flange attaching the band top end to the handle, and further wherein in the collapsed position and the extended position, the band top end and at least a portion of the top flange are located above the tube top end. Optionally, the tube interior has a tube interior width generally perpendicular to the tube length and the top flange has a top flange width generally parallel to the tube interior width, and further wherein the top flange width is greater than the tube interior width. Optionally, the at least one strap is adjustable. Optionally, the least one strap comprises a fastener. Optionally, the at least one strap has a strap length generally perpendicular to the tube length. Optionally, the band is substantially fully contained in the tube interior in the collapsed position. Optionally, the tube comprises a top piece comprising the tube top end and having a first width, the top piece mated to a bottom piece comprising the tube bottom end and having a second width, the first width greater than the second width. Optionally, in the collapsed position at least a portion of the handle is seated in the top piece. Optionally, the handle comprises a handle bar oriented generally perpendicular to the tube length. In an alternative embodiment, the handle is oriented generally parallel to the tube length. Optionally, the band top end and the band bottom end are knotted. Optionally, the system further comprises a plate connecting the at least one strap to the at least one tube, the plate configured to rest against the user's limb. In some embodiments, the system is used in a method that includes: a) providing the retractable exercise band system; b) placing the at least one strap around the user's leg; c) grasping the handle with the user's hand; and d) moving the retractable exercise band system from the collapsed position to the extended position to the collapsed position while performing a curl.

Optionally, the at least one strap is located adjacent to the user's knee.

BRIEF DESCRIPTION OF THE DRAWINGS

in FIG. 1, the elastic band is in the collapsed position.

in FIG. 2, the elastic band is in the extended position.

in FIG. 3, the elastic band is in the collapsed position.

in FIG. 4, the elastic band is in the extended position.

in FIG. 5, the elastic band is in the extended position.

in FIG. 6, the elastic band is in the collapsed position.

in FIG. 7, the elastic band is in the extended position.

in FIG. 8, the elastic band is in the extended position.

in FIG. 9, the elastic band is in the extended position.

DETAILED DESCRIPTION

Figure 1:
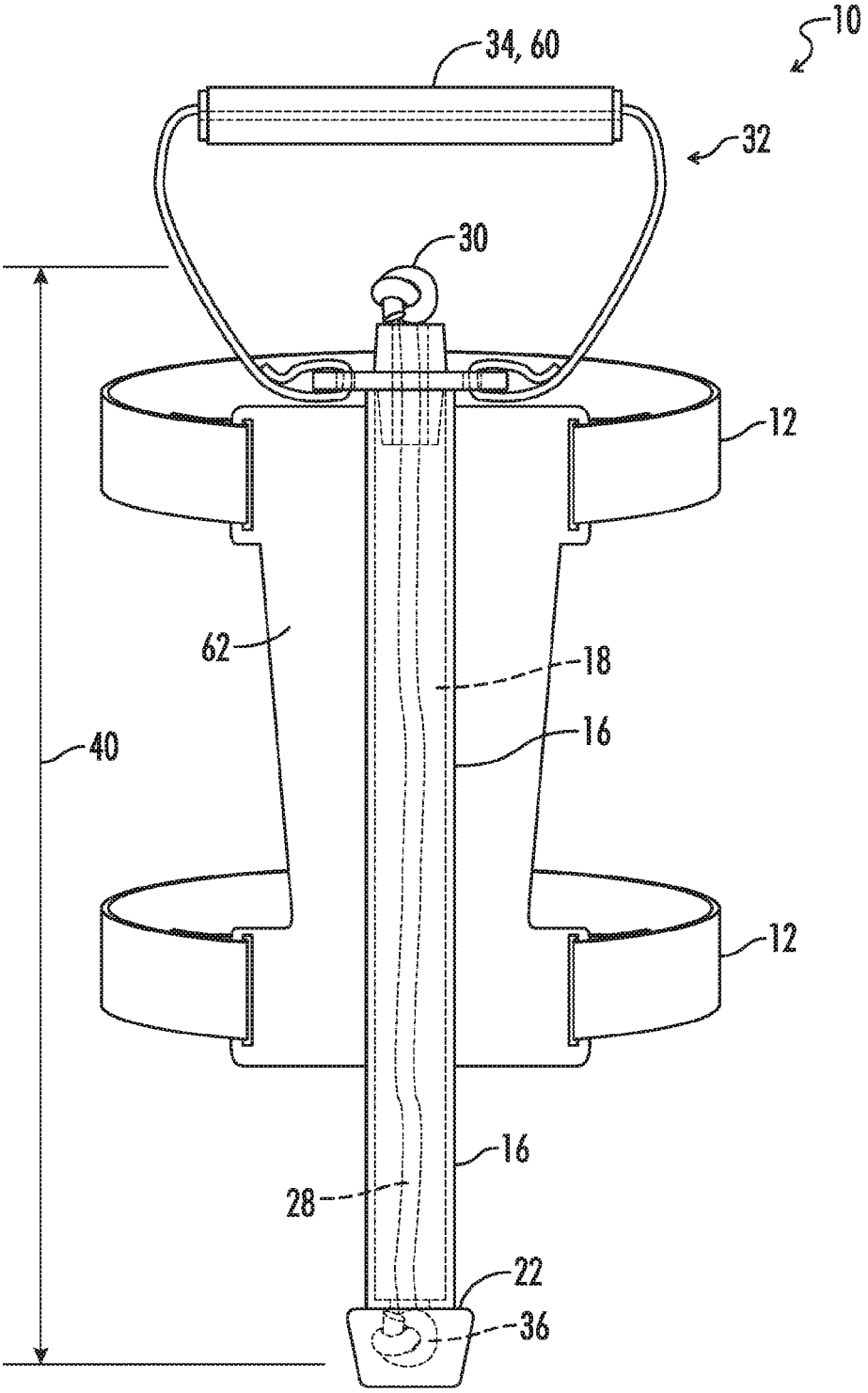
FIG. 1 illustrates a side elevation view of a retractable exercise band system of one embodiment of the present invention.
Figure 2:
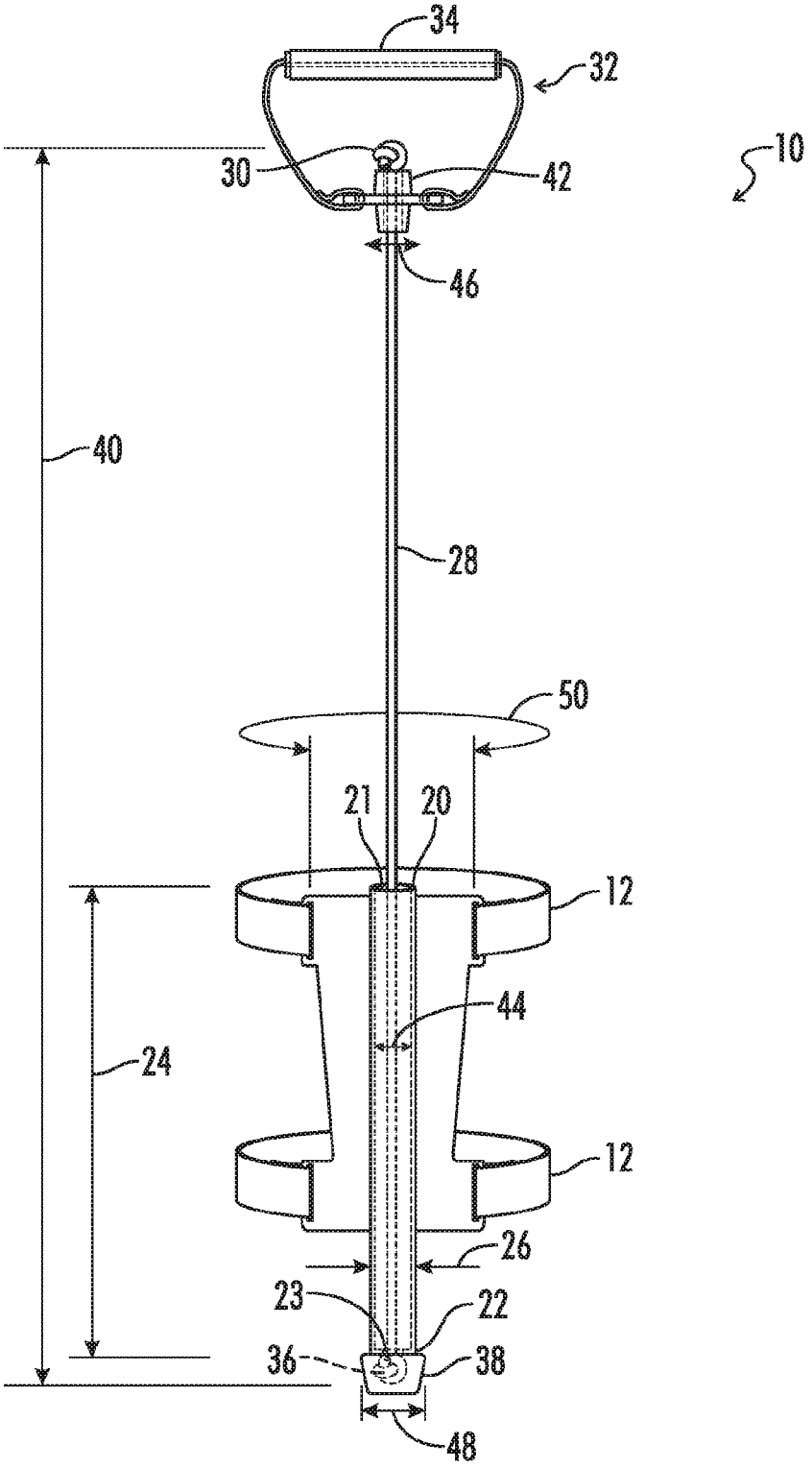
FIG. 2 illustrates a side elevation view of the retractable exercise band system of FIG. 1.
Figure 3:
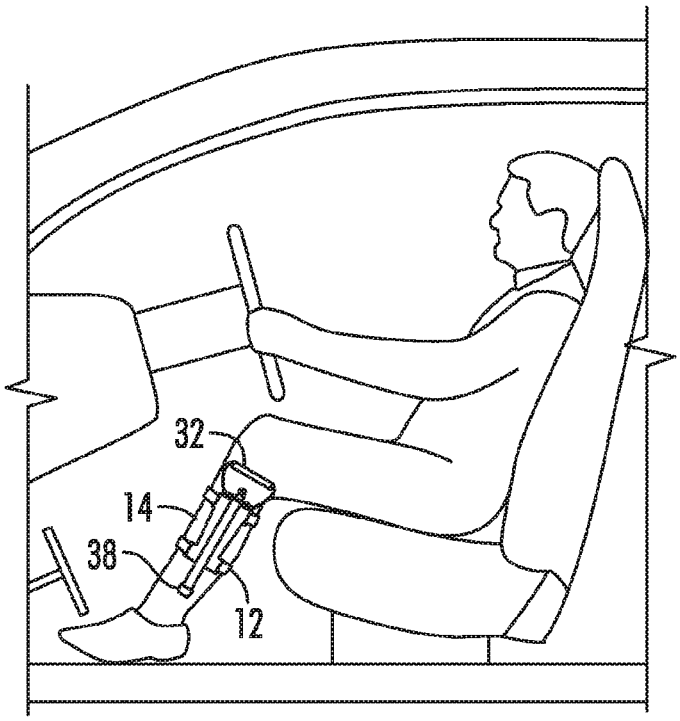
FIG. 3 illustrates a side elevation view of the retractable exercise band system of FIG. 1 worn by a user.
Figure 4:
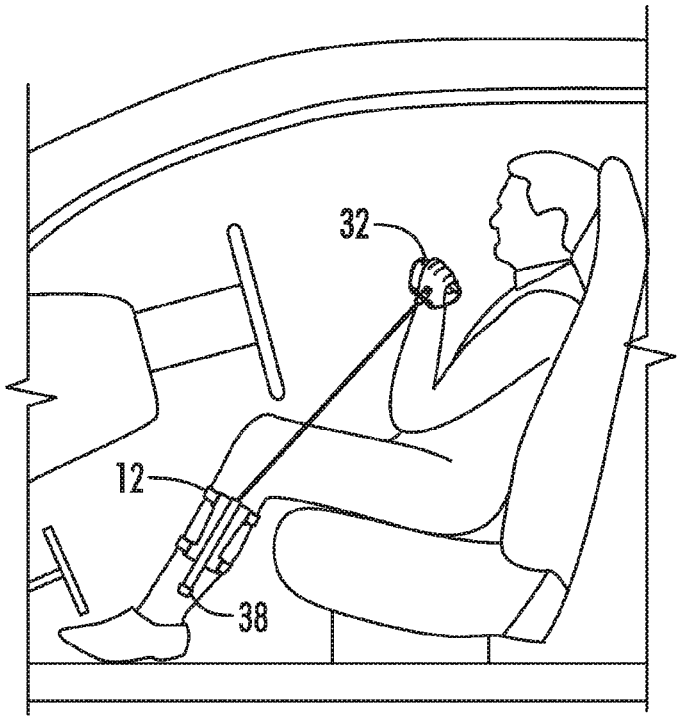
FIG. 4 illustrates a side elevation view of the retractable exercise band system of FIG. 1 worn by a user.

With reference to FIGS. 1-9, the present invention provides a retractable exercise band system designated by the numeral 10. In the drawings, not all reference numbers are included in each drawing for the sake of clarity. The retractable exercise band system 10 may be used by a user while sitting in a car or chair for example or while standing.

Referring further to FIGS. 1-9, the retractable exercise band system 10 may include at least one strap 12 configured to be worn around a user's limb 14. The retractable exercise band system 10 may further include a tube 16 connected to the at least one strap 12 and comprising a hollow interior 18, a tube top end 20 comprising a top opening 21, a tube bottom end 22 comprising a bottom opening 23, a tube length 24 extending from the tube top end 20 to the tube bottom end 22, and a tube width 26 generally perpendicular to the tube length 24. The retractable exercise band system 10 may further include an elastic band 28 located in the hollow interior 18 and comprising a band top end 30 attached to a handle 32 configured to be grasped by a user's hand, a band bottom end 36, a band length 40 extending from the band top end 30 to the band bottom end 36 and generally parallel to the tube length 24. Optionally, the band bottom end 36 is attached to a bottom flange 38. The handle 32 comprises a handle top 34, and optionally the band 28 has an extended position in which the band 28 has a first length 40 and in which the handle top 34 is located a first height above the tube top end 20, and the band 28 has a collapsed position in which the band 28 has a second length 40 and in which the handle top 34 is located a second height above the tube top end 20, the first length 40 greater than the second length 40, the first height greater than the second height. Optionally, in the collapsed position and in the extended position, the bottom flange 38 (if included) is located below the tube bottom end 22 and the band bottom end 36 is located below the tube bottom end 22. In other words, the band 28 may stretch when the user pulls on the band top end 30 (while the band bottom end 36 remains fixed by bottom flange 38 below the tube bottom end 22) due to the elastic nature of the band 28.

Optionally, the retractable exercise band system 10 further comprises a top flange 42 attaching the band top end 30 to the handle 32, and further wherein in the collapsed position and the extended position, the band top end 30 and at least a portion of the top flange 42 are located above the tube top end 20.

Optionally, the tube interior 18 has a tube interior width 44 generally perpendicular to the tube length 24 and the top flange 42 has a top flange width 46 generally parallel to the tube interior width 44, and further wherein the top flange width 46 is greater than the tube interior width 44. (In other words, the size and shape of the top flange 42 are designed so that the top flange 42 cannot pass through the tube interior 18). Optionally, the tube interior 18 has a tube interior width 44 generally perpendicular to the tube length 24 and the bottom flange 38 has a bottom flange width 48 generally parallel to the tube interior width 44, and further wherein the bottom flange width 48 is greater than the tube interior width 44. (In other words, the size and shape of the bottom flange 38 are designed so that the bottom flange 38 cannot pass through the tube interior 18).

Optionally, the at least one strap 12 is adjustable. Optionally, the at least one strap 12 comprises a fastener such as a hook and loop fastener. Optionally, the at least one strap 12 has a strap length 50 generally perpendicular to the tube length 24, as shown in FIGS. 1-9. The at least one strap 12 may be for example comprised of fabric. Optionally, the retractable exercise band system 10 has two parallel straps 12, as shown in FIGS. 1-9.

Optionally, the band 28 is substantially fully contained in the tube interior 18 in the collapsed position. (For example, at least about 95% of the band length 40 may be located in the tube interior 18 in the collapsed position)

Figure 5:
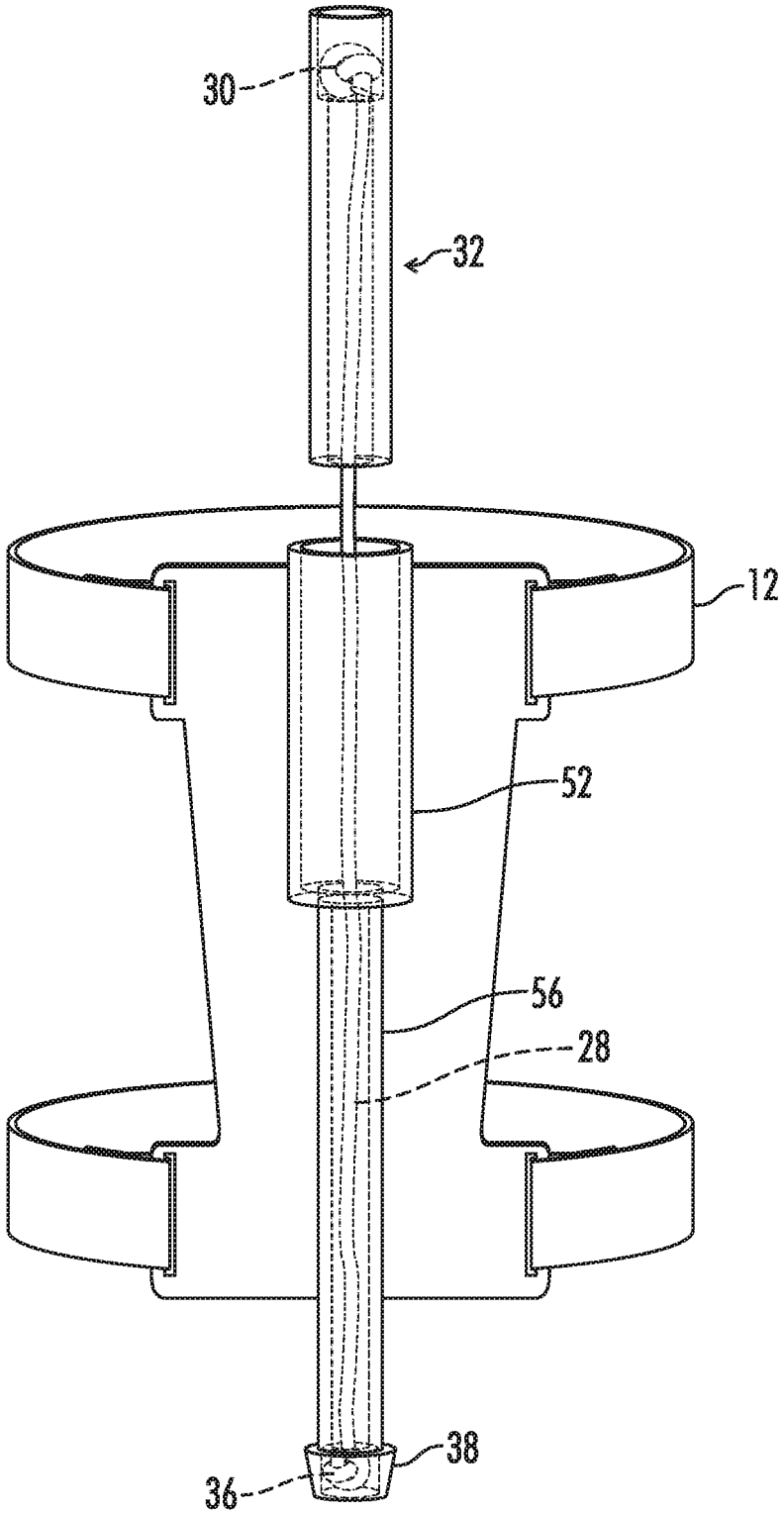
FIG. 5 illustrates a side elevation view of the retractable exercise band system of another embodiment of the present invention.
Figure 6:
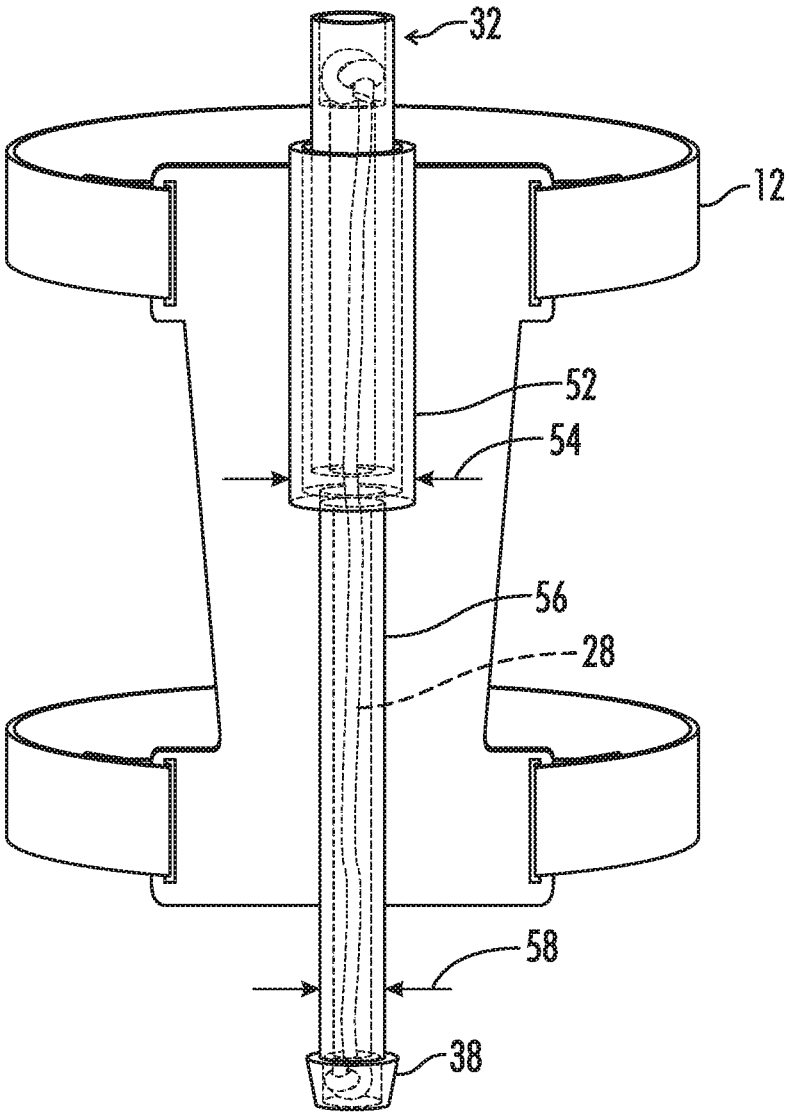
FIG. 6 illustrates a side elevation view of the retractable exercise band system of FIG. 5.
Figure 7:
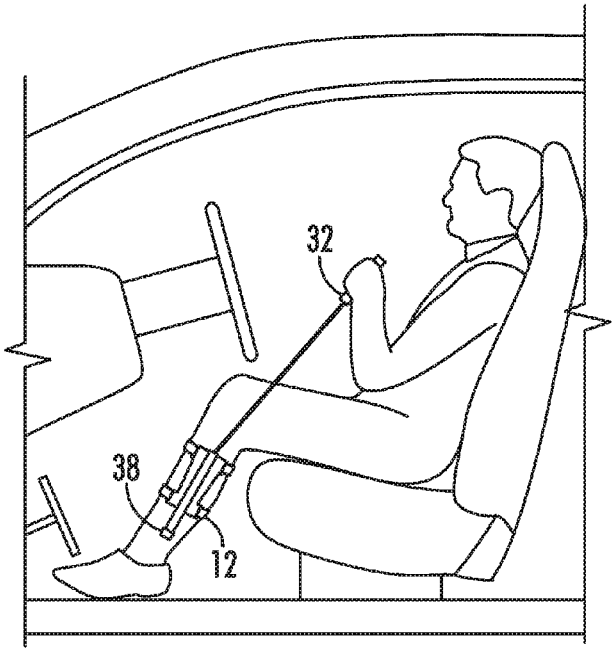
FIG. 7 illustrates a side elevation view of the retractable exercise band system of FIG. 5 worn by a user.
Figure 8:
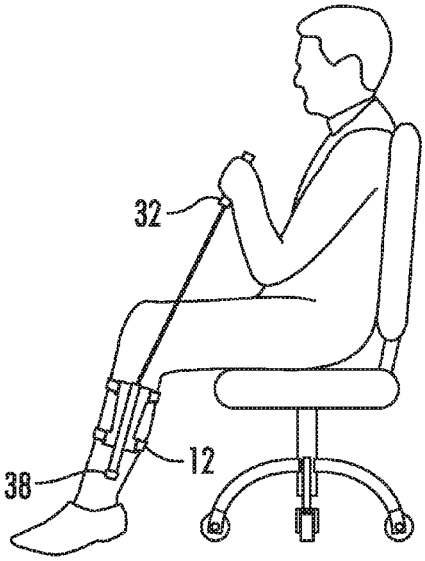
FIG. 8 illustrates a side elevation view of the retractable exercise band system of FIG. 5 worn by a user.
Figure 9:
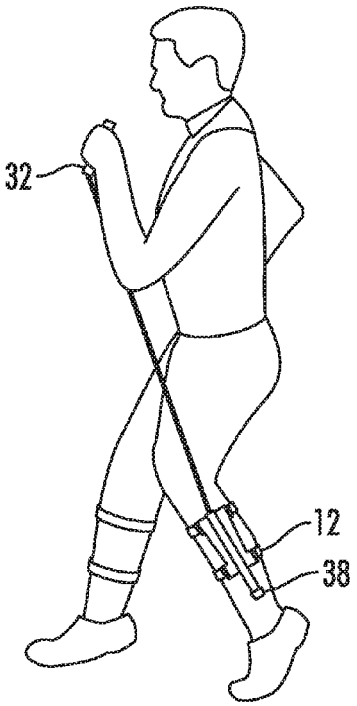
FIG. 9 illustrates a side elevation view of the retractable exercise band system of FIG. 5 worn by a user.

Optionally, as best seen in FIGS. 5-6, the tube 16 comprises a top piece comprising the tube top end 20 and having a tube top piece width 54, the top piece 52 mated to a bottom piece 56 comprising the tube bottom end 22 and having a tube bottom piece width 58, the tube top piece width 54 greater than the tube bottom piece width 58. Optionally, in the collapsed position at least a portion of the handle 32 is seated in the top piece 52, as shown in FIG. 6. It will be appreciated that the handle 32 design may vary, with FIGS. 1-4 showing a handle 32 with a handle bar 60 oriented generally perpendicular to the tube length 24. By contrast, FIGS. 5-9 show a handle 32 that is oriented generally parallel to the tube length 24. Optionally, the band top end 30 and the band bottom end 36 are knotted.

Optionally, the retractable exercise band system 10 further comprises a plate 62 connecting the at least one strap 12 to the at least one tube 16, the plate 62 configured to rest against the user's limb 14.

The retractable exercise band system 10 may be used in any suitable method. As an example, the retractable exercise band system 10 may be used by a human user having at least one leg and at least one hand in a method that includes a) providing the retractable exercise band system 10; b) placing the at least one strap 12 against the user's limb 14 (e.g., the user's leg); c) grasping the handle 32 with the user's hand; and d) using the user's hand to move the retractable exercise band system 10 from the collapsed position to the extended position and back to the collapsed position while performing a curl.

Optionally, the at least one strap 12 is located adjacent to the user's knee.

PART LIST system 10
strap 12
user's leg 14
tube 16
hollow interior 18
tube top end 20
top end opening 21
tube bottom end 22
bottom end opening 23
tube length 24
tube width 26
elastic band 28
band top end 30
handle 32
handle top 34
band bottom end 36
bottom flange 38
band length 40
ten flange 42
tube interier width 44
top flange width 46
bottom flange
width 48
strap length 50
tube top piece 52
tube top piece
width 54
tube bottom piece 56
tube bottom piece width 58
handle bar 60
Plate 62

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

What is claimed is:

1. A retractable exercise band system comprising:

a) at least one strap configured to be worn around a user's limb;

b) a tube connected to the at least one strap and comprising a hollow interior, a tube top end comprising a top opening, a tube bottom end comprising a bottom opening, a tube length extending from the tube top end to the tube bottom end, and a tube width generally perpendicular to the tube length; and c) an elastic band extending through the tube hollow interior and comprising a band top end connected to a handle configured to be grasped by a user's hand, a band bottom end, a band length extending from the band top end to the band bottom end and generally parallel to the tube length;

wherein the handle comprises a handle top, wherein the band has an extended position in which the band has a first length and in which the handle top is located a first height above the tube top end, wherein the band has a collapsed position in which the band has a second length and in which the handle top is located a second height above the tube top end, the first length greater than the second length, the first height greater than the second height, and further wherein, in the collapsed position and the extended position, the band bottom end is located below the tube bottom end.

2. The retractable exercise band system of claim 1, wherein the band bottom end is connected to a bottom flange and further wherein in the collapsed position and the extended position, the bottom flange is located below the tube bottom end.

3. The retractable exercise band system of claim 2, wherein the tube interior has a tube interior width generally perpendicular to the tube length and the bottom flange has a bottom flange width generally parallel to the tube interior width, and further wherein the bottom flange width is greater than the tube interior width.

4. The retractable exercise band system of claim 1, wherein the system further comprises a top flange attaching the band top end to the handle, and further wherein in the collapsed position and the extended position, the band top end and at least a portion of the top flange are located above the tube top end.

5. The retractable exercise band system of claim 4, wherein the tube interior has a tube interior width generally perpendicular to the tube length and the top flange has a top flange width generally parallel to the tube interior width, and further wherein the top flange width is greater than the tube interior width.

6. The retractable exercise band system of claim 1 wherein the at least one strap is adjustable.

7. The retractable exercise band of claim 6, wherein the least one strap comprises a fastener.

8. The retractable exercise band system of claim 7 wherein the at least one strap has a strap length generally perpendicular to the tube length.

9. The retractable exercise band system of claim 1, wherein the band is substantially fully contained in the tube interior in the collapsed position.

10. The retractable exercise band system of claim 1, wherein the tube comprises a top piece comprising the tube top end and having a top piece width, the top piece mated to a bottom piece comprising the tube bottom end and having a bottom piece width, the top piece width greater than the bottom piece width.

11. The retractable exercise band system of claim 10, in the collapsed position at least a portion of the handle is seated in the top piece.

12. The retractable exercise band system of claim 1, wherein the handle comprises a handle bar oriented generally perpendicular to the tube length.

13. The retractable exercise band system of claim 1, wherein the handle is oriented generally parallel to the tube length.

14. The retractable exercise band system of claim 1 wherein the band top end and the band bottom end are knotted.

15. The retractable exercise band system of claim 1 further comprising a plate connecting the at least one strap to the at least one tube, the plate configured to rest against the user's limb.

16. A method of using a retractable exercise band system by a user having at least one leg and at least one hand comprising:

a) providing the retractable exercise band system of claim 1;

b) placing the at least one strap around the user's leg;

c) grasping the handle with the user's hand; and d) moving the retractable exercise band system from the collapsed position to the extended position to the collapsed position while performing a curl.

17. The method of claim 16, wherein the at least one strap is located adjacent to the user's knee.

* * * * *